US008568158B2

(12) United States Patent
Mangus

(10) Patent No.: US 8,568,158 B2
(45) Date of Patent: Oct. 29, 2013

(54) FOREIGN OBJECT DAMAGE PROTECTING ELECTRICAL CONNECTOR BACKSHELL ADAPTOR

(75) Inventor: Jerod Mangus, Andover, KS (US)

(73) Assignee: M-Pyre, L.L.C., Wichita, KS (US)

( * ) Notice: Subject to any disclaimer, the term of this patent is extended or adjusted under 35 U.S.C. 154(b) by 14 days.

(21) Appl. No.: 13/345,393

(22) Filed: Jan. 6, 2012

(65) Prior Publication Data

US 2013/0178088 A1 Jul. 11, 2013

(51) Int. Cl.
*H01R 13/648* (2006.01)

(52) U.S. Cl.
USPC ..... 439/465; 439/472; 439/607.47

(58) Field of Classification Search
USPC ..... 439/465, 469, 607.47, 472
See application file for complete search history.

(56) References Cited

U.S. PATENT DOCUMENTS 3,571,781 A * 3/1971 Gartland et al. ..... 439/465
3,784,961 A * 1/1974 Gartland, Jr. ..... 439/465
4,005,922 A * 2/1977 Burkhart et al. ..... 439/465
4,902,248 A 2/1990 Robertson
5,021,006 A * 6/1991 Fargeaud et al. ..... 439/469
5,178,559 A 1/1993 Mello
5,304,075 A * 4/1994 Hoffman ..... 439/472
5,308,259 A * 5/1994 Liao ..... 439/320
5,354,213 A * 10/1994 Hoffman ..... 439/469
5,474,473 A 12/1995 Perretta et al.
5,536,183 A 7/1996 Brandolf
5,562,483 A * 10/1996 Hoffman ..... 439/469
5,641,305 A * 6/1997 Lutz et al. ..... 439/469
5,769,665 A 6/1998 Neely et al.
6,739,900 B2 * 5/2004 Mortun et al. ..... 439/469
6,805,578 B2 * 10/2004 Chiou et al. ..... 439/469
6,918,785 B1 7/2005 Reilly
7,641,504 B1 1/2010 Pedruzzi

* cited by examiner

*Primary Examiner* — Gary F. Paumen
(74) *Attorney, Agent, or Firm* — Kenneth H. Jack; Davis & Jack, L.L.C.

(57) ABSTRACT

A foreign object damage protecting electrical connector backshell adaptor including a nipple having a forward end, a rearward end, a hollow bore, and a wall surrounding the hollow bore; an adaptor mounting coupling nut fixedly attached to the nipple's forward end; a retention flange, the retention flange being fixedly attached to or formed wholly with the nipple's rearward end, the retention flange having a seam dividing the retention flange at least into a movable clamp jaw segment and an opposing clamp jaw segment; clamp actuating screws connected operatively to the retention flange for drawing the movable clamp jaw segment from a cable receiving position to a cable clamping position; a tubular sheath and receptacle extending rearwardly from and annularly about the retention flange; and an annular clamping band engaging the tubular sheath forwardly from the retention flange.

10 Claims, 8 Drawing Sheets

FOREIGN OBJECT DAMAGE PROTECTING ELECTRICAL CONNECTOR BACKSHELL ADAPTOR

FIELD OF THE INVENTION

This invention relates to electrical connector backshell adaptors. More particularly, this invention relates to electrical connector backshell adaptors which are specially configured for receiving an electrical power or electrical signal transmitting cable bundle within the adaptor's hollow bore and for securely mounting a forward end of a cable bundle shielding tubular sheath.

BACKGROUND OF THE INVENTION

A commonly configured electrical connector backshell adaptor assembly comprises a metal tubular nipple having a hollow bore, such nipple commonly having a rotatable coupling nut or other common fastener mounted at its forward end. In use of such backshell adaptors, such forward end mounting means are utilized for securely attaching the adaptor to an electrical junction box or to an item of electronic equipment which is served by a cable bundle which extends through the nipple's bore.

The rearward end of such electrical connector backshell adaptor is known to present a pair of annular ridges which form an annular channel for receiving annular clamping means. Upon extension of the cable bundle through the bore of such adaptor, an electromagnetic flux (EMF) shielding cable sheath may be extended over the cable bundle and over the outer periphery of the adaptor's rearward extension. Thereafter, annular clamping means such as a constant force spring, a "Band-It" band, or a "Magna-form" ring may be utilized to attach the forward end of such cable sheath to the nipple. The extreme rearward end of such adaptor nipples commonly present an annular and radially outwardly extending flange, and such annular clamping means are commonly placed upon the nipple at a forward position in relation to such flange. Upon such annular clamping means positioning, the annular clamp and the flange work mechanically together for secure attachment of the sheath.

A problem associated with such common backshell adaptor assemblies is that such assemblies' cable bundle protecting sheaths are commonly capable of elastically longitudinally stretching a distance greater than the stretching tolerance of the contained cable bundles. As a result of such differential in stretching tolerances, a strong pulling force applied simultaneously to a sheath and to the cable bundle contained within the sheath, may cause the cables within the sheath to break or become disconnected while leaving the outer sheath intact. Such pull force damage events are highly undesirable since they may render electronic equipment served by the cable assembly inoperable.

In order to attempt to solve or ameliorate such pull force damage events, electrical connector backshell adaptors are known to be outfitted or specially equipped with a mechanical "O" clamp which receives and compressively engages both the sheath and a cable bundle contained by the sheath. Such "O" clamps are known to be positioned rearwardly from the adaptor by a pair of rearwardly extending support arms, the proximal ends of which are mounted upon the outer wall of the adaptor's nipple. In operation, such "O" clamp modifications transmit pulling forces applied to the bundle and sheath directly to the nipple, protecting the internally contained cable bundle from excessive strain.

A problem or defect associated with such known "O" clamp adaptations of backshell adaptors relates to the additional parts which are introduced into sensitive mechanical and electronic environments. Such "O" clamp assemblies commonly comprise numerous separate parts, such as a pair of extension arms, a pair of extension arm mounting screws, a pair of semi-circumferential clamping jaws, and a pair of clamp jaw actuating screws. Upon long use and exposure to vibrations, such added parts tend to loosen, resulting in undesirable shedding or dropping of metal parts. Shedding of loosened metal parts creates a risk of foreign object damage in the nature of electronic and/or mechanical interference with the functions of electronic equipment or machinery within which the backshell adaptor assembly is installed.

The instant inventive foreign object damage protecting electrical connector backshell adaptor solves or ameliorates the problems and defects set forth above, while preserving basic mechanical functions, as described above, by specially configuring the rearward retention flange portion of a backshell adaptor's nipple to dually function as an annular clamp and sheath retaining means and as a mechanical cable bundle compressing "O" clamp, such dual function adaptation allowing the assemblies' cable sheath to correspondingly dually function as a cable bundle protecting shield and as a foreign objects collecting receptacle.

BRIEF SUMMARY OF THE INVENTION

A first structural component of the instant inventive foreign object damage protecting electrical connector backshell adaptor comprises a nipple having a forward end, a rearward end, a hollow bore, and a typically circumferential wall surrounding the hollow bore. The nipple component may suitably be configured as a straight line nipple, as a 45° angled nipple, as a 90° angled nipple, or may assume some other angular geometry. For simplicity of description, adaptor descriptions drawn and described below are directed to a straight line nipple. Notwithstanding, all such descriptions are intended to be representative of differently angled backshell adaptor configurations. Also, in descriptions below the nipple's bore is drawn and described as circular. Such circular configuration is intended as being representative of other lateral cross-sectional geometries such as oval, square, and rectangular.

A further structural component of the instant inventive adaptor comprises adaptor mounting means which are preferably fixedly attached to the nipple's forward end. In one suitable embodiment, the adaptor mounting means comprise a helically threaded rotatable coupling nut. Suitably, other commonly known mounting means such as mounting plates or plain helically threaded joints may be utilized.

A further structural component of the instant inventive backshell adaptor comprises a retention flange which is situated at the nipple's rearward end. Upon extension of a flexible tubular sheath over the nipple's rearward end and over such retention flange, an annular clamp such as a spirally wrapped constant force spring, "Band-it" band, or "Magna-form" ring may be extended about the sheath and about the nipple for annularly clamping the sheath to the nipple. Upon utilization of such clamp, the retention flange advantageously performs a function of retaining both the sheath and the annular clamp upon the nipple.

According to the invention, the nipple's rearward retention flange component is specially adapted to include a seam which divides the retention flange into segments which include a movable "O" clamp jaw segment and an opposing "O" clamp jaw segment, such opposing "O" clamp jaw segment preferably being immovable or sessile in relation to the nipple. In a preferred embodiment, the adaptor's seam element comprises a plurality of seam extensions which include a pair of axial or longitudinally extending seam extensions and a semi-circumferential seam extension, the semi-circumferential seam extension spanning between and interconnecting the axial seam extensions. In a preferred embodiment, and where the seam element comprises the preferred combination of axial and semi-circumferential extensions, the seam effectively divides the nipple's retention flange to functionally present a pair of opposed "O" clamp jaws which are capable of clamping radially inwardly against a cable bundle which extends through the nipple's bore.

A further structural component of the instant inventive adaptor comprises clamp actuating means which are connected operatively to the retention flange, the clamp actuating means being adapted for drawing the movable clamp jaw segment from an extended cable receiving position to a retracted cable clamping position. In a preferred embodiment, the clamp actuating means comprise at least a first, and preferably a pair of jack screw assemblies.

In use of the instant inventive foreign object damage protecting electrical connector backshell adaptor, the adaptor mounting means may be initially utilized to securely attach the forward end of the adaptor's nipple portion to an electrical component which is to be served by electrically conductive cables. Thereafter, the clamp actuating means may be operated to position the movable clamp jaw segment of the retention flange to an extended cable receiving position. Thereafter, a bundle of cables may be extended through the bore of the nipple, and between the jaws of the retention flanges' movable and opposing clamp jaw segments. Thereafter, the clamp actuating means may be operated to draw or retract the movable clamp jaw segment toward the cable bundle, effectively compressing the cable bundle and securing the cable bundle against the opposing clamp jaw segment. Thereafter, a flexible tubular sheath which encases the rearward extension of the cable bundle may be forwardly extended along the cable bundle until the forward opening of the flexible tubular sheath extends over and nestingly receives the outer periphery of the nipple.

Thereafter, an annular clamp such as a constant force spring, a "Band-It" band, or a "Magna-form" ring may be extended about the nipple and sheath assembly at a point forward from the retention flange, such clamp securing the sheath about the nipple. Upon such assembly, and in the event of vibration induced disassembly of parts of the retention flange's cable bundle clamping "O" clamp assembly, stray parts falling from such assembly advantageously resides within the annular interior space of the tubular sheath. Accordingly, the sheath advantageously further functions as a stray parts receptacle. Such sheath advantageously continuously prevents foreign object damage which might otherwise result from dropping of parts into machinery and electronic component environments. While the "O" clamp modification of the nipple's retention flange remains operable for cable bundle clamping, rearwardly directed pulling forces applied to the sheath and to the cable bundle advantageously translate directly to the nipple via the annular clamping means and the "O" clamp modification of the retention flange, rather than allowing a pulling force to damage the cable bundle.

Accordingly, objects of the instant invention include the provision of a foreign object damage protecting electrical connector backshell adaptor which incorporates structures, as described above, and which arranges those structures in manners described above, for the performance of beneficial functions, as described above.

Other and further objects, benefits, and advantages of the instant invention will become known to those skilled in the art upon review of the Detailed Description which follows, and upon review of the appended drawings.

BRIEF DESCRIPTION OF THE DRAWINGS

FIG. 2A presents an alternate configuration of the structure of FIG. 2, the view of FIG. 2A additionally showing a prior art external cable bundle and sheath engaging "O" clamp assembly.

DETAILED DESCRIPTION OF PRIOR ART AND A PREFERRED EMBODIMENTS

Figure 1:
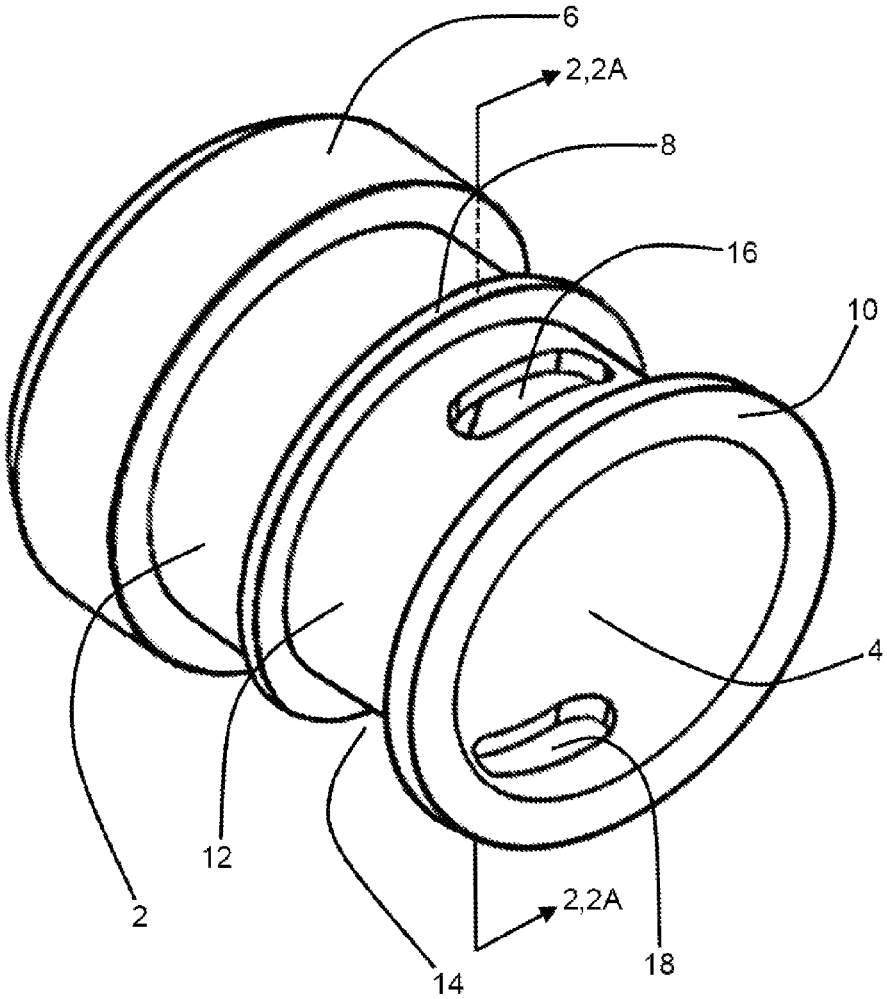
Fig. 1 (Prior Art)
FIG. 1 is a perspective view of a prior art electrical connector backshell adaptor.
Figure 2:
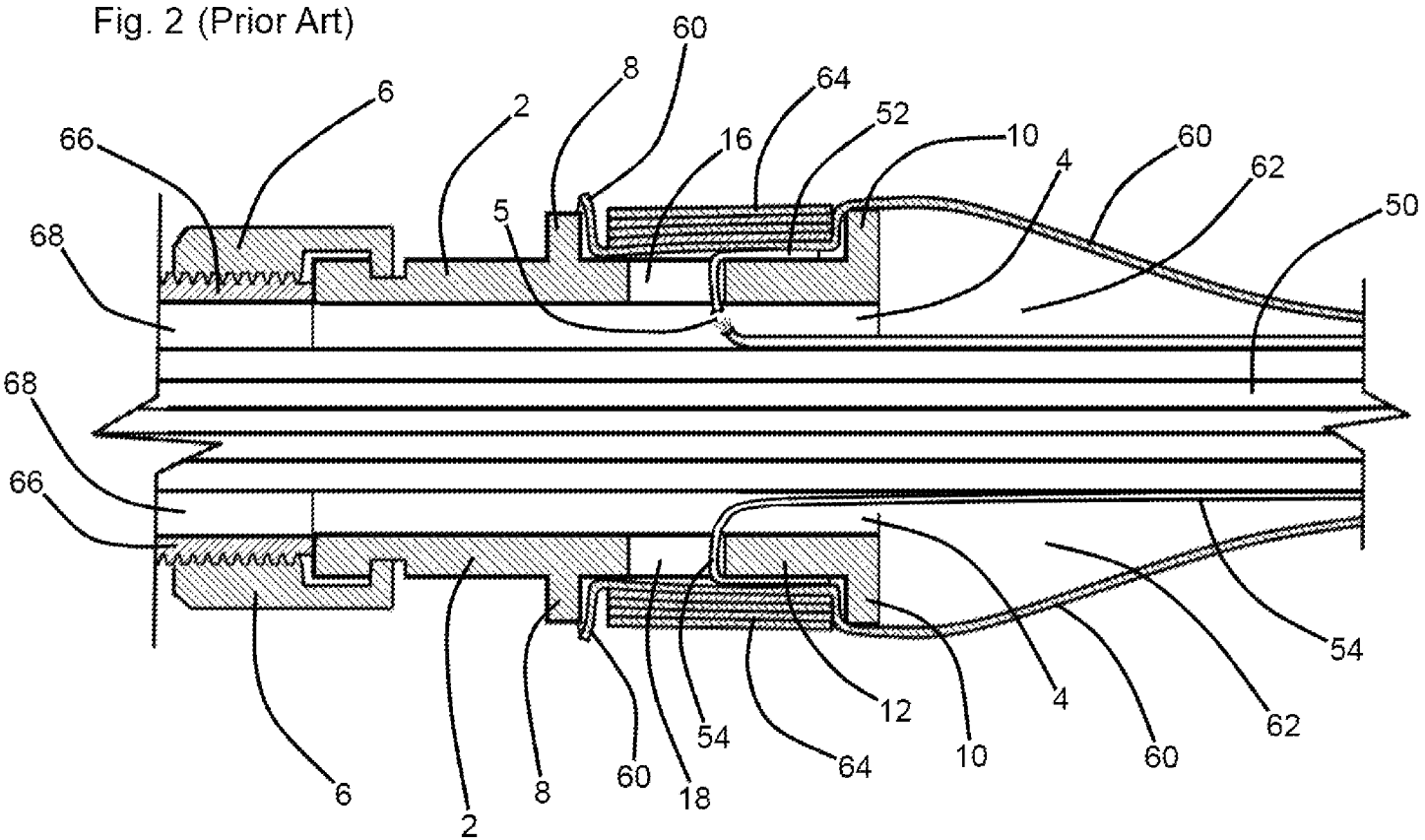
Fig. 2 (Prior Art)
FIG. 2 is a sectional view as indicated in FIG. 1, the view of FIG. 2 showing additional structures including a junction box mounting nipple, a cable bundle, a cable sheath, and an annular clamping constant force spring.
Figure 2:
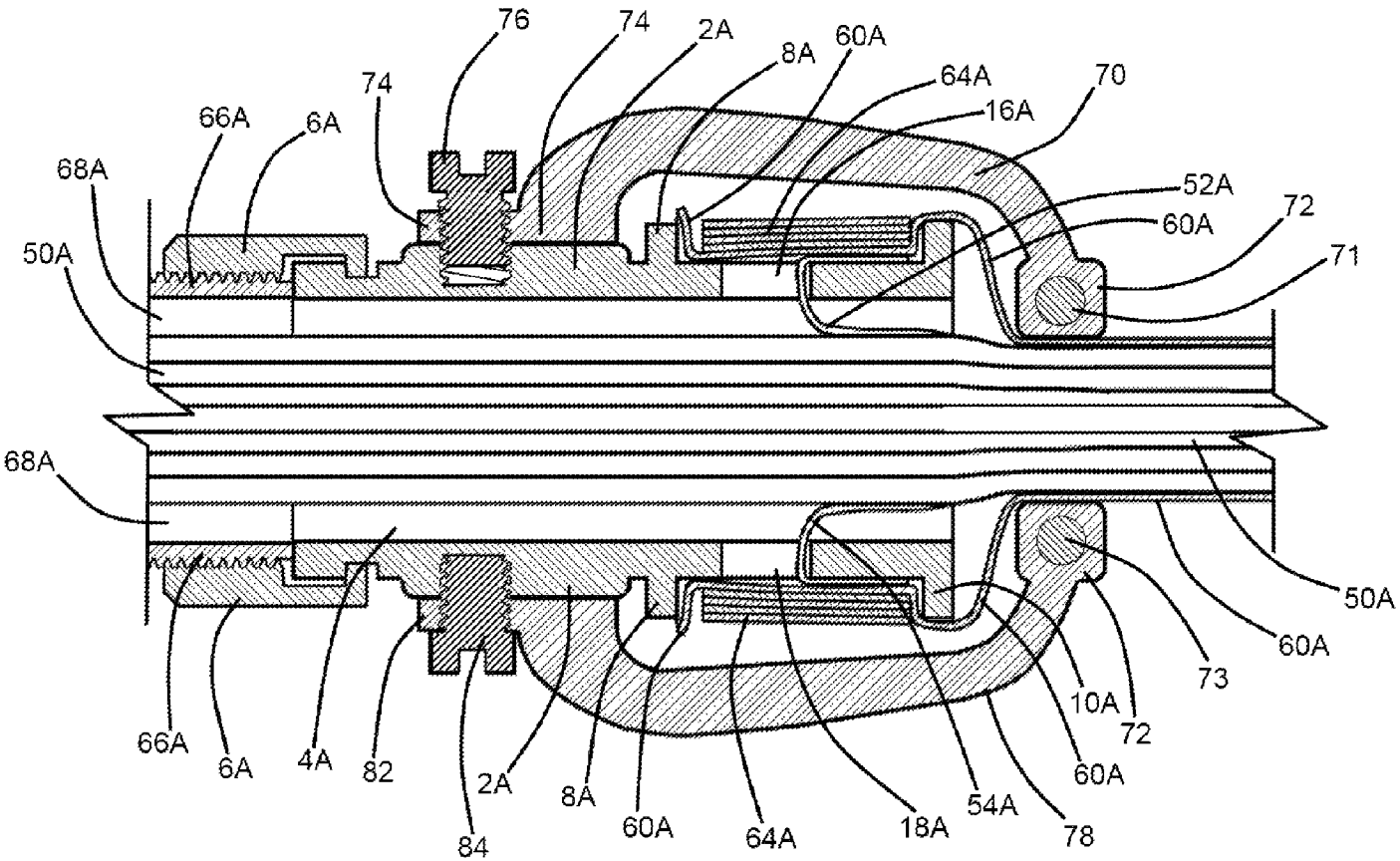
Fig. 2 A (Prior Art)

Referring now to the drawings, and in particular to Drawing FIGS. 1 and 2, a prior art electrical connector backshell adaptor assembly is represented. In such assembly, a tubular and typically cylindrical nipple is provided, such nipple having a circumferential wall or body portion 2 and having a longitudinally extending hollow bore 4. Means for mounting the backshell adaptor upon a helically threaded nipple 66 of an electrical component junction box port 68 are provided, such means being represented by an internally helically threaded rotatable coupling nut 6. The rotatable coupling nut mounting means 6 is intended as being representative of other commonly known fasteners which are capable of securely mounting a nipple structure at an electronic component cable port.

Referring further simultaneously to FIGS. 1 and 2, an annular retention flange 10 is fixedly attached to or formed wholly with the rearward end of the nipple. Such flange 10, in combination with a relatively forwardly placed flange 8, forms a cable sheath and annular clamp receiving channel 14, the floor of such channel 14 comprising an annular nipple wall section 12.

Referring further simultaneously to FIGS. 1 and 2, upon helically threaded mounting of the rotatable coupling nut 6, a bundle of electrically conductive cables or wires 50 may be extended through the bore 4 of the nipple, and thence through port opening 68 for electrical communication with electronic components (not depicted within views). Upon such extension of cables 50, a flexible tubular cable sheath 60 having a hollow interior bore 62 which contains and protects cables 50 may be extended forwardly until the forward opening of the sheath 60 nestingly receives and annularly overlies the nipple. In a preferred embodiment, the sheath 60 comprises an electro-magnetic flux or EMF shielding metal wire braid.

Upon extension and positioning of the sheath 60, as depicted in FIG. 2, an annular clamp, preferably in the form of a spirally wrapped constant force spring 64, may be wrapped about the nipple and about the forward end of the sheath 62, such spring 64 radially inwardly compressing the sheath 60 into the channel 14 which is formed between flanges 8 and 10. At such position, the spring 64 works in combination with the retention flange 10 to securely attach the forward end of the sheath 60 to the nipple.

Referring further simultaneously to FIGS. 1 and 2, at least a first, and preferably a plurality of grounding wire extension ports 16 and 18 are provided, such ports 16 and 18 allowing electrical grounding wires 52 and 54 among the cable bundle 50 to be extended outwardly to overlie the floor 12 of the annular channel 14 which is formed by annular flanges 10 and 8. Upon such extensions of the grounding wires 52 and 54, the annular clamp 64 dually functions for securing the sheath 60 and for maintaining electrical grounding of wires 52 and 54.

In the event that a rearwardly directed pulling force is simultaneously applied to the sheath 12, to the cable bundle 50, and to the grounding wires 52 and 54, differences in elasticity existing between the sheath 60 and the cable bundle 50,52,54 may cause such pulling force to be initially translated to the cable bundle, causing undesirable interior breakages such as grounding wire break 5.

Referring simultaneously to FIGS. 1, 2, and 2A, all reference numerals bearing the suffix "A" are structurally similar to similarly numbered structures appearing in FIGS. 1 and 2. In order to guard against and prevent pull force breakages such as grounding wire break 5, backshell adaptor assemblies such as the FIGS. 1 and 2 adaptor are known to be modified to include a strain relieving "O" clamp assembly such as is represented in FIG. 2A. In such strain relief assembly, an "O" clamp 72 is actuated by screws 71 and 73 to securely annularly clamp cable bundle 50A, including grounding wires 52A and 54A. Mounting arms 70 and 78 whose distal ends support the "O" clamp 71,72,73 have their proximal ends mounted upon the wall 2A of the nipple by mounting plate and mounting screw combinations 74,76, and 82,84. Upon application of a rearwardly directed pulling force simultaneously to the sheath 60A, to the cable bundle 50A, and to grounding wires 52A and 54A, such pulling force is immediately translated to the nipple via the "O" ring 71,72,73 and the arms 70 and 78. Accordingly, the "O" clamp modified prior art backshell adaptor of FIG. 2A advantageously prevents cable breakages and disconnections.

While the "O" clamp modified backshell adaptor of FIG. 2A effectively relieves strain which may undesirably cause internal breakage of cable bundle wires, such assembly undesirably creates a risk of foreign object damage. For example, upon long use including vibration, a mounting screw such as screw 76 may undesirably move to the loosened position which is depicted in FIG. 2A. Upon continuation of such screw loosening, screw 76 may fall out of and away from the backshell adaptor assembly, undesirably falling into other mechanisms and electronic components, and undesirably interrupting or interfering with their normal functions.

Figure 3:
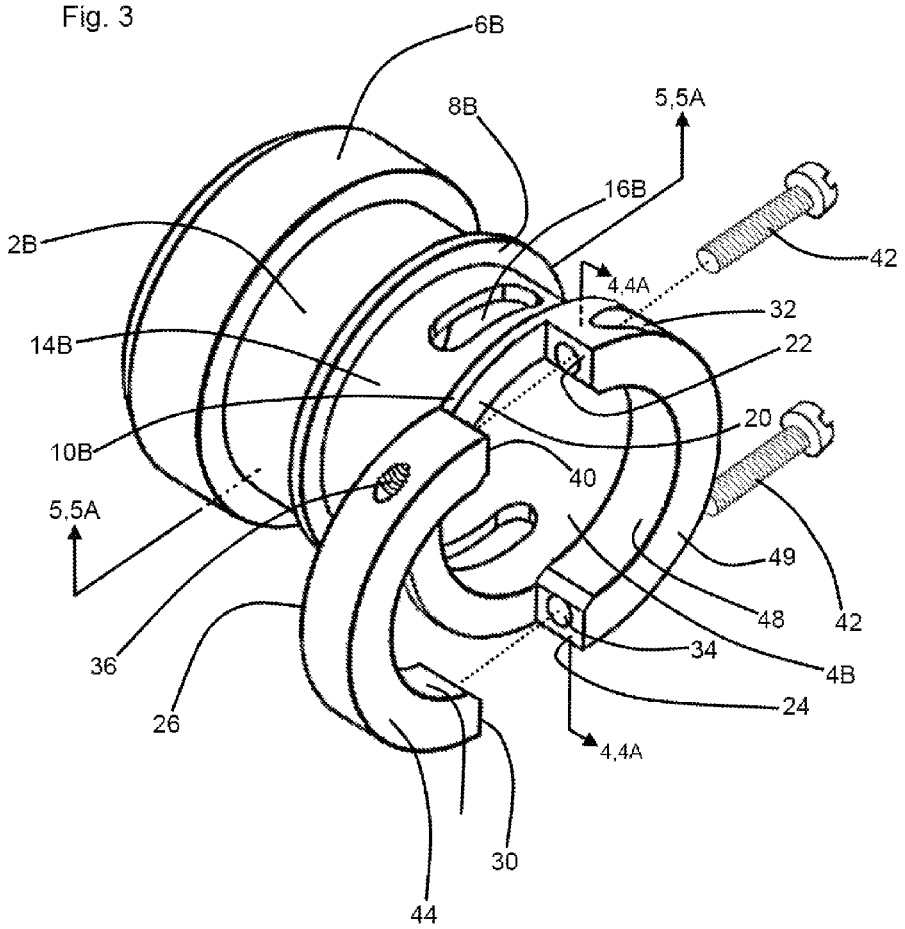
FIG. 3 presents a perspective view of a preferred embodiment of the instant inventive backshell adaptor, the view showing movable clamp jaw and jaw actuating screws in disassembled and exploded view positions.

Referring to FIG. 3, all structures identified with a "B" suffix are structurally similar to similarly numbered structures of prior drawings. In order to solve or ameliorate the threat of foreign object damage which arises upon use of assemblies such as the adaptor of FIG. 2A, the instant invention specially adapts the adaptor's rearward flange 10B to include a seam which segments the flange 10B into a movable "O" clamp jaw portion 44, and an opposing and preferably relatively sessile "O" clamp jaw portion 49, such jaw clamp elements respectively having opposing jaw faces 46 and 48. In order to effectively adapt the rearward flange 10B for performance of an "O" clamping function, the seam element preferably includes a pair of axial extensions having circumferentially aligned faces 22,40 and 24,30. The seam element preferably further includes a circumferential extension which has axially aligned faces 20 and 26, the circumferential extension spanning between and integrally interconnecting the axial seam extensions.

Figure 4:
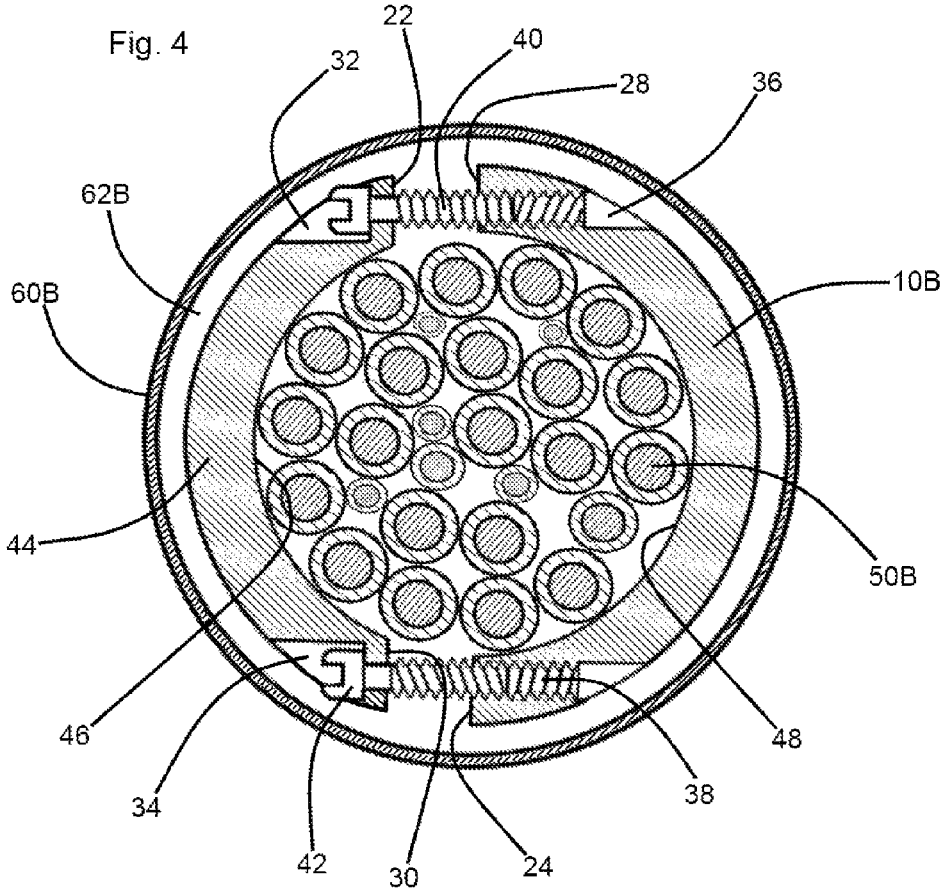
FIG. 4 is a sectional view as indicated in FIG. 3, the view of FIG. 4 additionally representing attached cable sheath and cable bundle components.
Figure 4A:
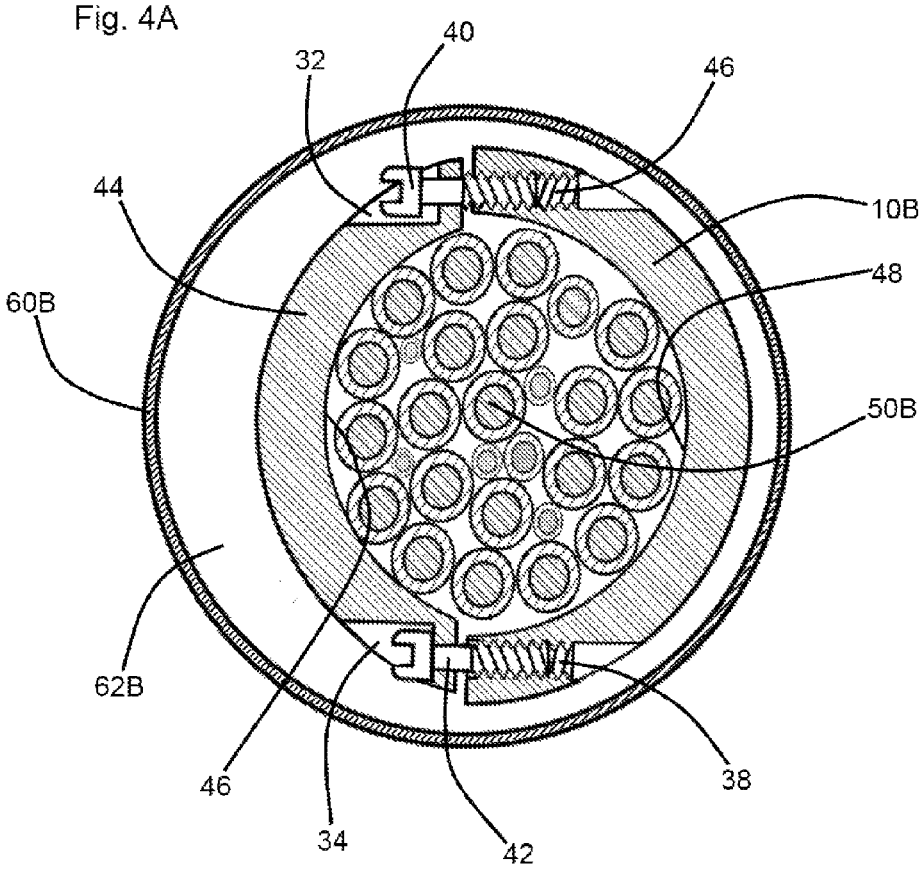
FIG. 4A redepicts FIG. 4, the view of FIG. 4A showing a movable clamp jaw segment retracted to a cable bundle clamping position.
Figure 5:
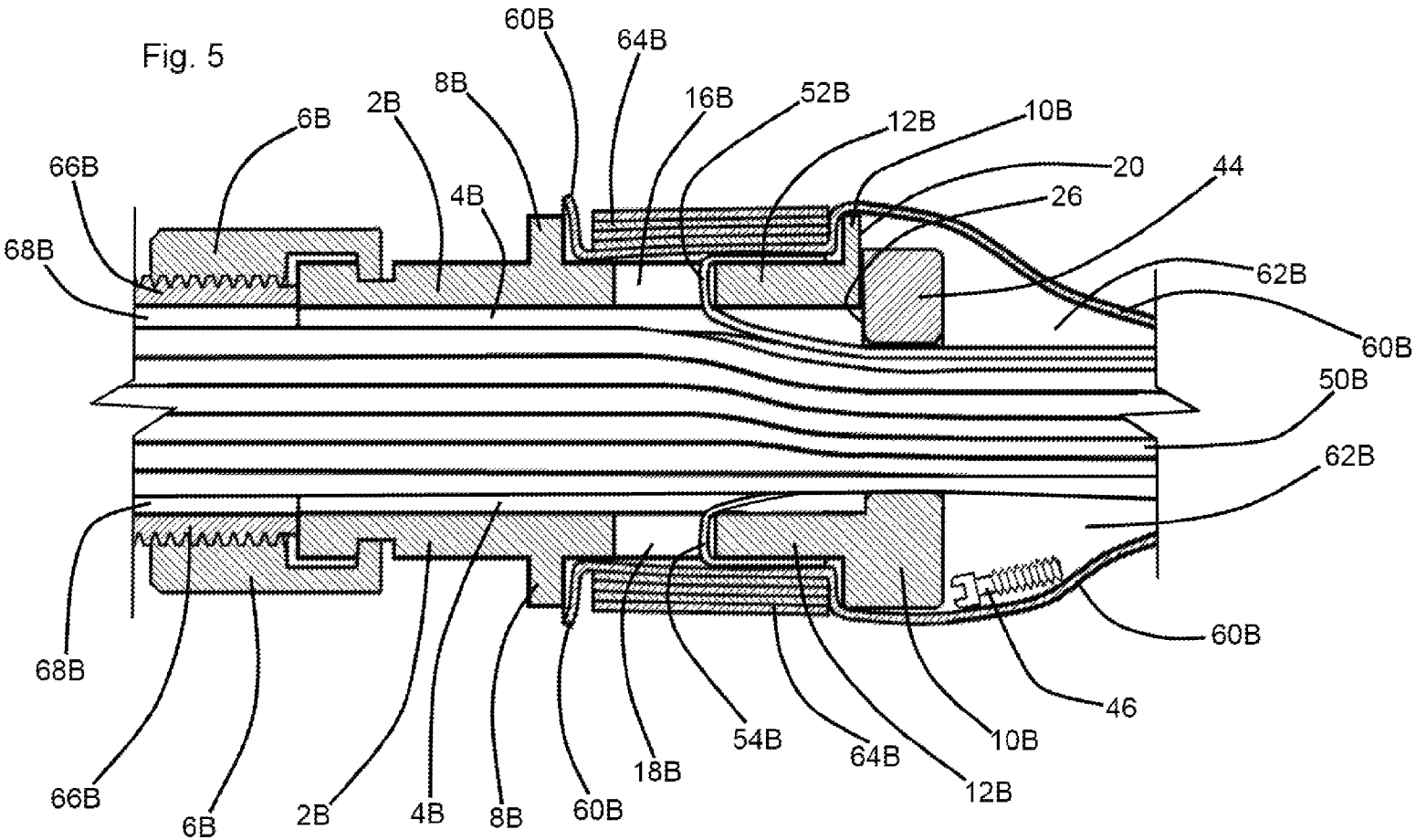
FIG. 5 is a sectional view, as indicated in FIG. 4, the view of FIG. 5 additionally showing junction box nipple, cable bundle, cable sheath, and constant force spring structures.

Referring simultaneously to FIGS. 3-5, the instant inventive foreign object damage protecting electrical connector backshell adaptor preferably further comprises clamp actuating means. According to the embodiment depicted in FIG. 3, the clamp actuating means comprise at least a first jack screw assembly, and preferably comprise a pair of jack screw assemblies 40,32,36, and 42,34,38. Upon extension of the screws 40 and 42 through screw receiving channels 32 and 34, such screws may threadedly engage helically threaded channels 36 and 38. Upon passage of cable bundle 50B between the jaw faces 46 and 48 and upon extension of the cables longitudinally through the bore 4B of the nipple, such screws 40 and 42 may be turned to draw and retract the movable jaw 44 toward the cable bundle 50B, and to securely hold and compress the cable bundle 50B against the sessile jaw wall 48 as indicated in FIG. 4A.

Thereafter, referring further simultaneously to FIGS. 3-5, a flexible tubular sheath 60B (preferably being composed of EMF shielding wire braid) whose bore 62B receives and contains the cable bundle 50B, may be extended forwardly until the forward end of the sheath 60B passes beyond the retention flange 10B and annularly overlies channel 14B. Thereafter an annular clamping means such as constant force spring 64B may be wrapped about nipple and about the forward end of the sheath 60B to compress such sheath's forward end annularly and radially inwardly into channel 14B. Upon such sheath and annular clamp positioning and installation, the annular clamp 64B works in combination with the retention flange 10B for maintaining a secure attachment of the sheath 60B to the nipple.

Referring further simultaneously to FIGS. 3-5, the channel floor portion 12B of the nipple preferably has at least a first, and preferably a plurality of grounding wire extension ports 16B and 18B. Where the cable bundle 60B includes grounding wires 52B and 54B, forward ends of such wires may be radially outwardly extended through ports 16B and 18B to overlie the floor of the channel 14. Upon such grounding wire extension and positioning, the annular clamping means 64B multiply functions for securing the sheath 60B, for securing the grounding wires 52B and 54B, and for maintaining grounding electrical contacts of such wires.

Referring simultaneously to FIGS. 2-5, in the event that a rearwardly directed pulling force is simultaneously applied to the sheath 62B, to the cable bundle 50B, and to the grounding wires 52B and 54B, such pulling force is advantageously immediately translated to the nipple via the compressive action of the retention flange's "O" clamp modification, and via the annular clamping action of the constant force spring 64B and retention flange 10B combination. Such direct translation of pulling forces to the nipple advantageously protects the cable bundle 50B from internal damage and breakages such as is represented by break 5 of FIG. 2.

Referring simultaneously to FIGS. 3-5, and in particular to FIG. 4, screw 40 is shown in a loosened state, such loosening being caused by, for example, long use of the assembly in a vibrating environment. Continued use and vibration may, on occasion, cause such screw 40 to completely detach. Upon such detachment, the annulus 62B which is formed and defined by the forward end of the cable sheath 60B advantageously functions as a stray parts receiving and retaining receptacle. As depicted in FIG. 5, such receptacle function is enabled by the modification of the nipple's retention flange 10B to include seam extensions 20,26,22,40,24,36, which allows a cable clamping function to be performed within the same sheath structure which is retained by that flange. Accordingly, as various parts of such cable clamping structure (such as screw 46) loosen, such parts fall into and are retained within the receptacle annulus 62B which is formed by cable sheath 60B. Thus, the modification of the invention allows the retention flange and the sheath to symbiotically functionally serve each other, the retention flange holding the sheath and the sheath lessening foreign object damage arising as a result of the flange's additional performance of a cable clamping function.

Figure 5A:
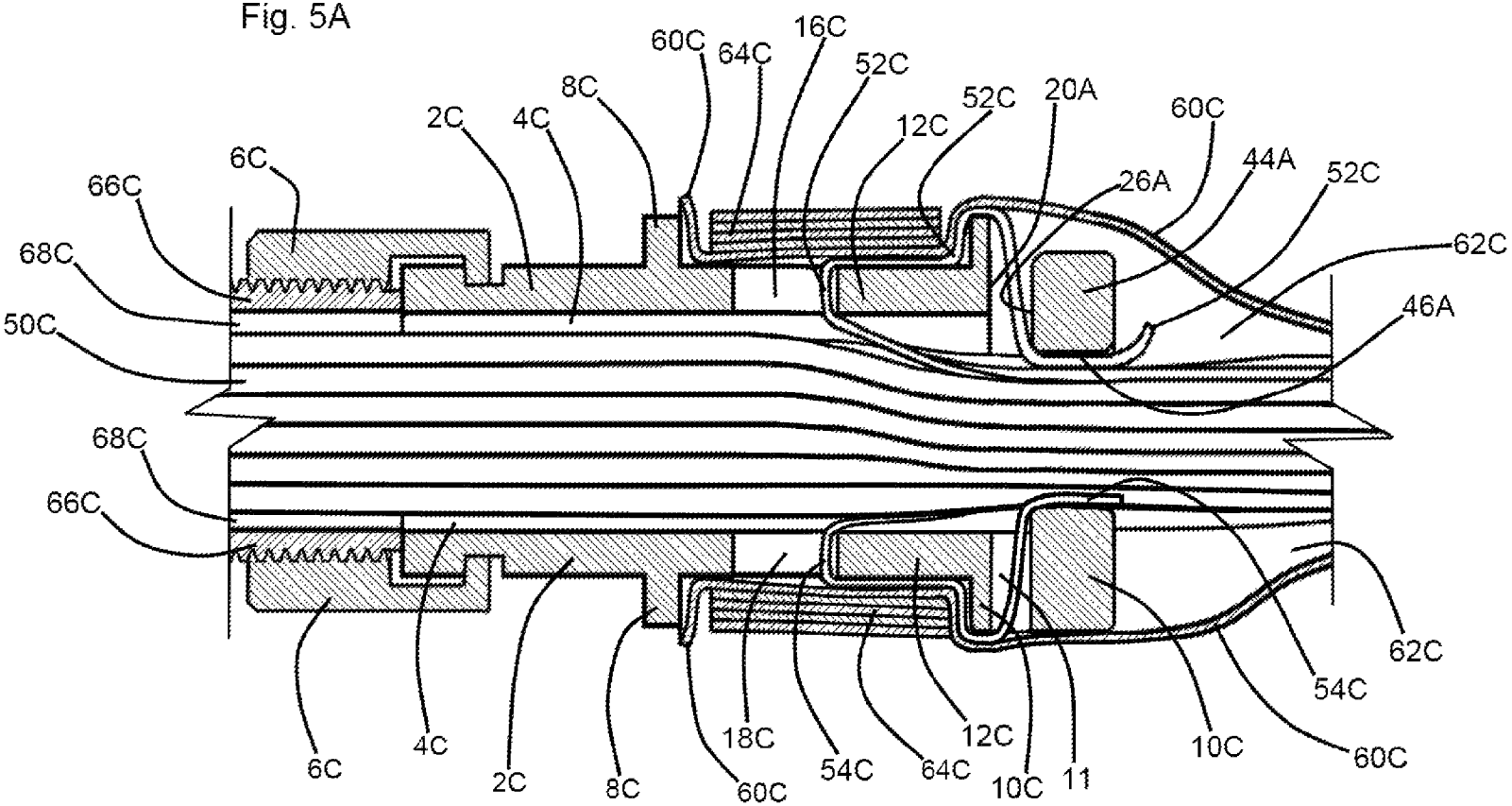
FIG. 5A depicts an alternative to the structure of FIG. 5, the view of FIG. 5A including a longitudinally expanded retention flange circumferential seam.

In FIG. 5A, all structural components having the suffix "C" are configured similarly with similarly numbered structures represented in prior drawings. Additionally, "O" clamp structures in FIG. 5A having a suffix "A" are configured similarly with similarly numbered "O" clamp structures appearing in FIG. 5. Referring to FIG. 5A, the circumferential extension of the "O" clamp forming seam of retention flange 10C is longitudinally widened so that axial seam face 26A is displaced longitudinally rearwardly from axial seam face 20A. Such longitudinal extension and widening of the circumferential seam extension element advantageously provides a second or additional port for extension of grounding wire 52C. Upon provision of such widened seam/port, wire 52C may be extended beneath the sheath 60C rearwardly over the forward end of retention flange 10C to extend radially inwardly between seam faces 20A and 26A, and to then extend further rearwardly beneath the movable clamp jaw 44A. Accordingly, such widening of the circumferential seam extension element advantageously allows the "O" clamp modification of the retention flange 10C to assist the annular clamping means 64C in further securely attaching and clamping the grounding wire 52C. Where a grounding wire such as grounding wire 54C is not situated within cable bundle 50C for extension into the circumferential seam 20A,26A, an additional and oppositely positioned cable extension port 11 may be provided, such cable extension port 11 extending through the retention flange 10C in a manner similar to the cable extension ports 16C and 18C.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A foreign object damage protecting electrical connector backshell adaptor comprising:

(a) a nipple having a forward end, a rearward end, a hollow bore, and a wall surrounding the hollow bore;

(b) adaptor mounting means fixedly attached to the nipple's forward end;

(c) a retention flange, the retention flange having a rearward end and a forward end, the retention flange's forward end comprising an outer sheath contacting edge, the retention flange being fixedly attached to or formed wholly with the nipple's rearward end, the retention flange further comprising a seam, the seam being positioned between the retention flange's rearward and forward ends and the seam dividing the retention flange at least into a movable clamp jaw segment and an opposing clamp jaw segment;

(d) clamp actuating means connected operatively to the retention flange, the clamp actuating means being adapted for drawing the movable clamp jaw segment from a cable receiving position to a cable clamping position.

2. The foreign object damage protecting electrical connector backshell adaptor of claim 1 wherein the retention flange's seam comprises first and second axial extensions and a semi-circumferential extension, the semi-circumferential extension spanning between the first and second axial extensions.

3. The foreign object damage protecting electrical connector backshell adaptor of claim 2 wherein the seam's semi-circumferential extension is positioned forwardly from the retention flange's movable clamp jaw.

4. The foreign object damage protecting electrical connector backshell adaptor of claim 3 wherein the clamp actuating means comprise at least a first assembly, said assembly being operatively positioned at one of the seam's axial extensions.

5. The foreign object damage protecting electrical connector backshell adaptor of claim 4 further comprising a receptacle, the receptacle extending rearwardly from and annularly about the retention flange.

6. The foreign object damage protecting electrical connector backshell adaptor of claim 5 wherein the receptacle comprises a flexible tubular sheath having a forward end, the flexible tubular sheath having a forward opening, the nipple's rearward end being received within the flexible tubular sheath's forward opening.

7. The foreign object damage protecting electrical connector backshell adaptor of claim 6 further comprising annular clamping means, the annular clamping means being positioned forwardly from the retention flange, the annular clamping means engaging the flexible tubular sheath's forward end.

8. The foreign object damage protecting electrical connector backshell adaptor of claim 7 wherein the flexible tubular sheath comprises EMF shielding metal.

9. The foreign object damage protecting electrical connector backshell adaptor of claim 8 wherein the nipple comprises at least a first grounding wire extension port, the at least first grounding wire extension port opening the nipple forwardly from the retention flange.

10. The foreign object damage protecting electrical connector backshell adaptor of claim 9 further comprising a second grounding wire extension port, the second grounding wire extension port comprising the retention flange's semi-circumferential seam extension.

* * * * *